US008602055B2

(12) United States Patent
Rüb

(10) Patent No.: US 8,602,055 B2
(45) Date of Patent: Dec. 10, 2013

(54) HYDRAULIC VALVE DEVICE

(75) Inventor: Winfried Rüb, Waldshut-Tiengen (DE)

(73) Assignee: Hydac Filtertechnik GmbH, Sulzbach/Saar (DE)

( * ) Notice: Subject to any disclaimer, the term of this patent is extended or adjusted under 35 U.S.C. 154(b) by 477 days.

(21) Appl. No.: 12/735,581

(22) PCT Filed: Dec. 18, 2008

(86) PCT No.: PCT/EP2008/011167

§ 371 (c)(1),
(2), (4) Date: Sep. 24, 2010

(87) PCT Pub. No.: WO2009/095067

PCT Pub. Date: Aug. 6, 2009

(65) Prior Publication Data

US 2011/0005623 A1 Jan. 13, 2011

(30) Foreign Application Priority Data

Jan. 31, 2008 (DE) ..... 10 2008 006 879

(51) Int. Cl.
*F15B 13/06* (2006.01)
*F15B 13/08* (2006.01)

(52) U.S. Cl.
USPC ..... 137/596.16; 137/596; 137/596.14

(58) Field of Classification Search
USPC ..... 137/596, 596.14, 596.16
See application file for complete search history.

(56) References Cited

U.S. PATENT DOCUMENTS

| | | | | |
|---|---|---|---|---|
| 4,353,392 | A * | 10/1982 | Ruchser et al. | 137/596.16 |
| 5,725,392 | A * | 3/1998 | Bianca et al. | 439/590 |
| 5,924,439 | A * | 7/1999 | Miyazoe et al. | 137/269 |
| 6,026,856 | A * | 2/2000 | Miyazoe et al. | 137/596.16 |
| 7,204,273 | B1 * | 4/2007 | Zub et al. | 137/884 |
| 7,228,876 | B1 * | 6/2007 | Zub | 137/884 |
| 2007/0277519 | A1 * | 12/2007 | Jessen et al. | 60/462 |

FOREIGN PATENT DOCUMENTS

| | | | |
|---|---|---|---|
| DE | 197 15 020 | A1 | 10/1998 |
| DE | 603 04 663 | T2 | 8/2006 |
| EP | 1 370 773 | | 12/2003 |
| JP | 07 286602 | A | 10/1995 |
| WO | WO 2006/005496 | A1 | 1/2006 |

* cited by examiner

*Primary Examiner* — Craig Schneider
(74) *Attorney, Agent, or Firm* — Roylance, Abrams, Berdo and Goodman LLP

(57) ABSTRACT

A hydraulic valve device has a fluid port arrangement (10) with various ports extending at least partially in the valve housing (14), and has a movable control device (18) for at least partially activating the ports. The control device (18) can be acted on at two opposite control sides with a control pressure ($X_A$, $X_B$) of an activation unit (46). A valve device of narrow construction and functionally reliable is created by a media-conducting duct (66) with a guide path extending at least partially as an open duct channel that can be closed off by a cover part or by other housing parts of the multi-part valve housing (14), to conduct the control pressure ($X_B$) from the activation unit (46) to the assignable control side of the control device (18).

8 Claims, 3 Drawing Sheets

HYDRAULIC VALVE DEVICE

FIELD OF THE INVENTION

The invention relates to a hydraulic valve device with a fluid port arrangement extending at least partially in the valve housing, containing ports such as a pressure supply port P for making available a working pressure, a return port R, a section load sensing port LS, two control ports $P'_A$ and $P'_B$, and two useful ports A, B for making available a useful port pressure. A movable control device at least partially activates the ports of the fluidport arrangement. and can be pressurized with a control pressure $X_A$, $X_B$ of an assignable activation unit on two opposite control sides.

BACKGROUND OF THE INVENTION

EP 1 370 773 B1 discloses a directional control valve for controlling the pressure and flow of hydraulic oil to and from useful ports of at least one consumer. The pressure and flow can be controlled by a sliding plunger as the control device which can be moved in a spool bore and which can be activated by at least one drive, and by ring channels which are dynamically connected to it as part of the fluid port arrangement. At the center point of symmetry on one axis of symmetry, a tank port ring channel R and other ring channels are symmetrically located on both sides and are components of the fluid port arrangement of the directional control valve. The sliding plunger as a component of this control device is activated by an activation unit which stipulates the respective control pressure on the opposite control sides of the sliding plunger. The activation unit includes a differential cylinder which is located on one side of the actual valve housing, which induces activation for both stroke directions of the optionally two-part sliding plunger, and which constitutes a separate component.

WO 2006/005496 A1 discloses a generic valve device, in particular in the form of a valve arrangement of a lifting mechanism. The known solution is used to activate a double-acting lifting mechanism or the attachment device of an agricultural vehicle with a continuously adjustable directional control valve which forms a metering throttle and to which an individual pressure compensator is assigned. Via the pressure compensator a volumetric flow of hydraulic fluid flows to a working port A, B. The hydraulic fluid flows back via another working port A, B flowing out via a directional control valve to a low pressure port or tank port T. A pressure limitation valve is located in a working line between the directional control valve and the working port A, B.

The pressure limitation valve is preferably proportionally adjustable so that the pressure in the working line can be limited to different maximum values depending on the different operating states. To trigger the control device in the form of the sliding plunger of the indicated directional control valve, a control or pilot valve is used whose fluid-carrying output ports are connected to two control lines which are each routed to the face-side control spaces of the directional control valve. One control line leading to the control chamber side of the directional control valve, which side is farther away, is designed, coming from the control or pilot valve, as a long connecting bore which is very thin in cross section, for which suitable drilling tools must be made available. A solution comparable thereto is also shown in DE 603 04 663 T2.

SUMMARY OF THE INVENTION

An object of the invention is to provide an improved the known valve device that is reliable and can be produced economically in a space-saving manner.

This object is basically achieved by a valve device having, for relaying the control pressure from the activation unit to the assignable control side of the control device, a media-carrying channel. The media-carrying channel has a guide path extending at least partially as an open channel guide which can be closed off by the cover part or other housing parts of the multi-part valve housing as a shut-off part. The activation unit, preferably using the control or pilot valves, can act directly on the control device, preferably in the form of at least one control piston or valve piston, without an additional actuating piston in the form of a differential cylinder or the like being necessary for this purpose. By omitting a separate actuating piston, in addition to production costs, the necessary installation space can also be saved.

Based on the configuration according to the invention, the media-carrying channel with an open channel guide can be economically produced, for example, by a conventional cutting tool, and replaces the long and thin connecting bore for producing the pressure connection between the control side of the control device and the indicated activation unit. Production costs can then be reduced. The cover part or other housing part covers the open channel guide, even at high fluid pressures, and can be made very thin-walled in a space-saving manner. Valve solutions with a very narrow structure can then be achieved in a width that cannot be made available by the prior art.

In mobile directional control valves, as in the present case with electrical activation, the assignable activating electronics are often integrated into the valve housing for considerations of feasibility and space-savings. For pilot-controlled valves, as in this case, an activation pressure is used for moving the valve piston or sliding plunger. To the extent activation units located on both sides are used, the object is a compact and cost-favorable arrangement of the activation electronics for the two activating or pilot valves. These requirements are taken into account with the solution according to the invention, neither electrical nor hydraulic control lines need be installed outside on the valve housing. This arrangement is likewise shown in the prior art. The valve device solution according to the invention is preferably used in compact machines, preferably within the framework of exhaust gas aftertreatment and in cooling apparatus. The current exhaust gas guidelines in the major industrialized countries for this purpose require an increasingly higher construction effort so that for other components such as the indicated hydraulic solution, less and less installation space remains. The mobile directional control valves therefore need be designed to be especially narrow. This design is achieved with the hydraulic valve device according to the invention.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 1:
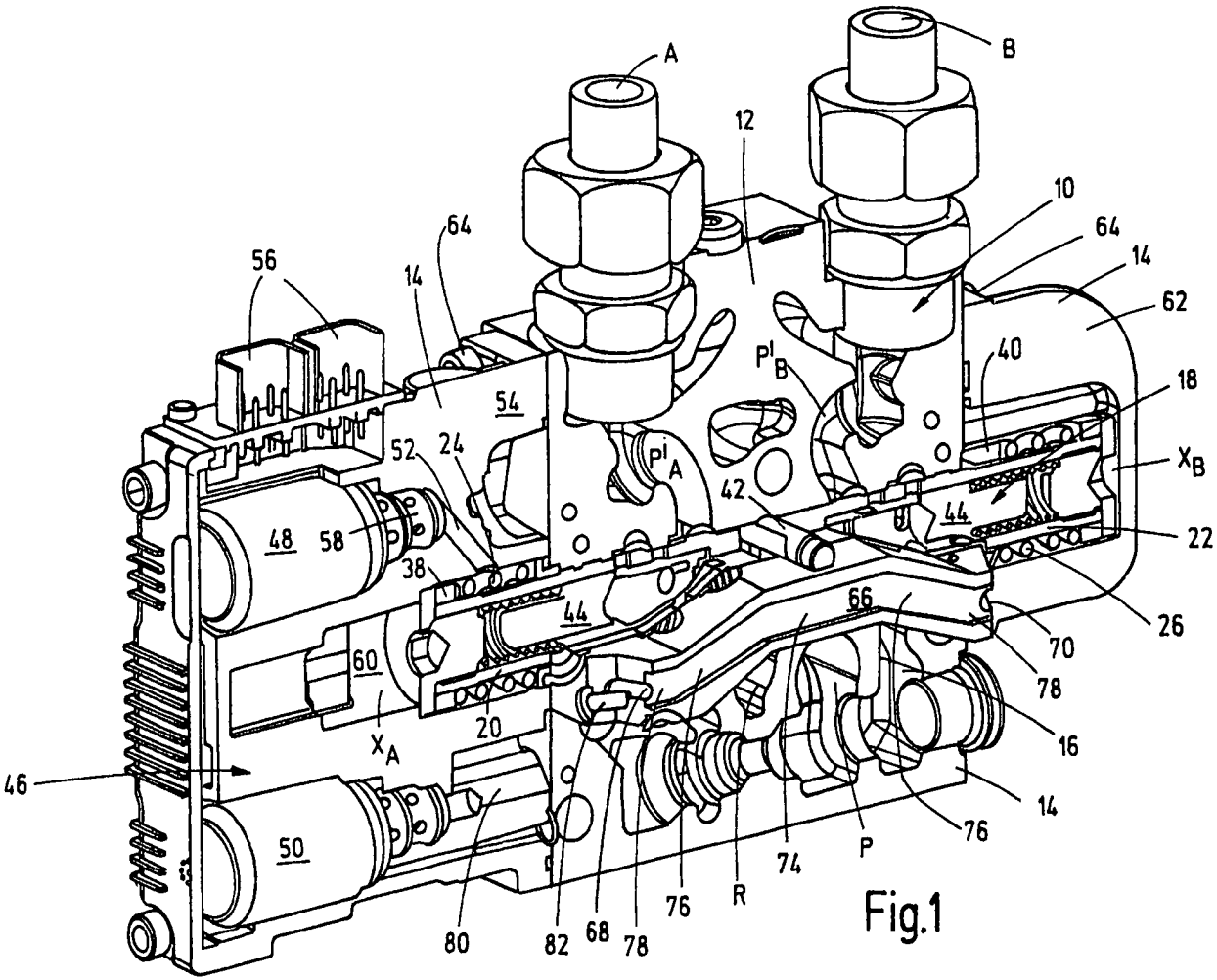
FIG. 1 is a perspective view in section of a valve device according to an exemplary embodiment of the invention.

The figures show a fluid port arrangement 10. This fluid port arrangement 10 has pressure supply port P for making available a working or pump pressure, a return port R, a section load sensing port LS, two control ports $P'_A$ and $P'_B$, and two useful ports A, B. These fluid ports LS, $P'_A$, RT and $P_B'$, A and B are accommodated in a control housing 12 as part of the valve housing 14. Viewed in the figures, the lower end of the control housing 12 has a common ring channel arrangement 16 into which if necessary a pressure compensator, which is not detailed, can be inserted and which then is connected upstream of the fluid port arrangement 10 in the fluid flow direction and can also activate the port arrangement. With this upstream pressure compensator, for example, the function of quantitative cut-off by LS pressure limitation would be possible. This quantitative cut-off, for example, makes sense when a steering cylinder, which is not detailed, connected to the useful ports A, B is at a stop. To prevent overloads, the inflow amount would be cut off. This valve device, however, manages in terms of its basic function without a respective pressure compensator connected upstream.

Furthermore, the hydraulic valve device according to the invention is equipped with a control device 18. The control device 18 is equipped with two spool valves 20, 22 which can be moved horizontally as viewed in FIG. 1 and which are shown in their undeflected, centered middle or neutral position. This neutral position of the respective spool valve 20, 22 is supported by two spring storages which are made as compression springs 24, 26 and which are integrated in a respectively assignable spring space 38, 40 within the illustrated housing arrangement. The illustrated spool valve arrangement with two spool valves 20, 22, depending on the application of the directional control valve, can also be made as a one-piece and therefore single-piston control arrangement (not shown). In this case, however, preferably a dual spool valve arrangement is chosen. The respective spool valves 20, 22 can be supported on a journal-shaped middle stop 42. Otherwise, the mechanical structure of the respective spool valve 20, 22 with an internally guided, spring-supported inner piston 44 is known, so that it will not be further detailed here.

Figure 2:
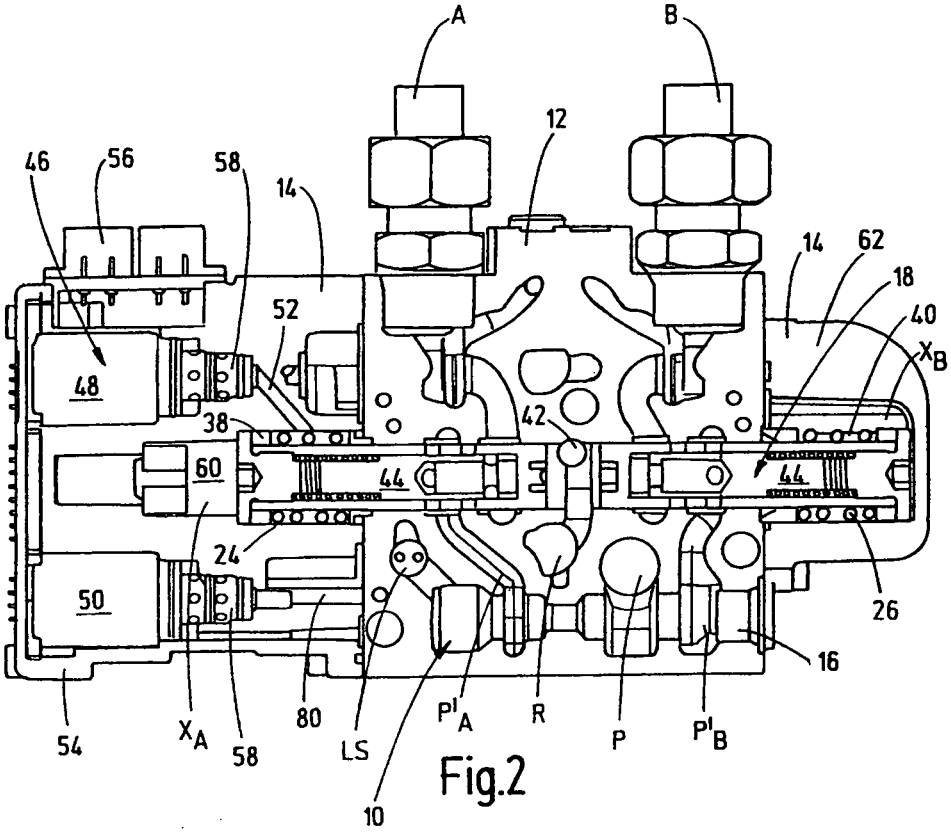
FIG. 2 is a front elevational view of the valve device of FIG. 1, but without fluid guidance in the form of a media channel.

To activate the control device 18 an activation unit 46 is used. Its essential components are two conventional control or pilot valves 48, 50 and are not further detailed. On the output side, the two pilot valves 48, 50 deliver two control pressures $X_A$ and $X_B$ which act in opposite directions, which prevail in the respective assignable spring space 38 and 40, and which here influence the two opposite control sides of the control device 18 with the two spool valves 20, 22. For penetration of the control pressure $X_A$ from the output side of the pilot valve 48 to the assigned control side in the form of the first spring space 38, an oblique bore 52 in the activation housing 54 is used. It is a component of the valve housing 14. The power or activation electronics 56 is contained at least partially in it, FIGS. 1 and 2 showing only the two plug parts illustrated above as an electrical terminal connection. The two control or pilot valves 48, 50, as shown in FIGS. 1 and 2, are shown in a vertical arrangement on top of one another. Their actuatable valve pistons 58 have adjustment directions parallel to the respective longitudinal displacement axis of the two spool valves 20, 22.

Otherwise, the spool valve 20, which is the left one viewed in FIGS. 1 and 2, engages a center middle recess 60 between the two valves 48, 50 in the activation housing 54. The activation housing 54 is connected as a flange port design to the left face side of the control housing 12 in order to implement a valve solution with a flat structure. On the opposite face side the right spool valve 22 discharges into a port housing 62 which in turn, for implementing a valve with a narrow structure, in width has only very small dimensions and in this case is connected to the opposite face side of the control housing 12 likewise as a flange port design without a projection. The respective flange connection is implemented by conventional screw connection designs 64, for the sake of simplicity not all attachment screws being shown. The port housing 62 moreover ensures a simpler mounting structure and allows dismounting of the overall valve arrangement for maintenance purposes. The control housing 12, the activation housing 54, and the port housing 62 together form the multi-part valve housing 14.

Figure 3:
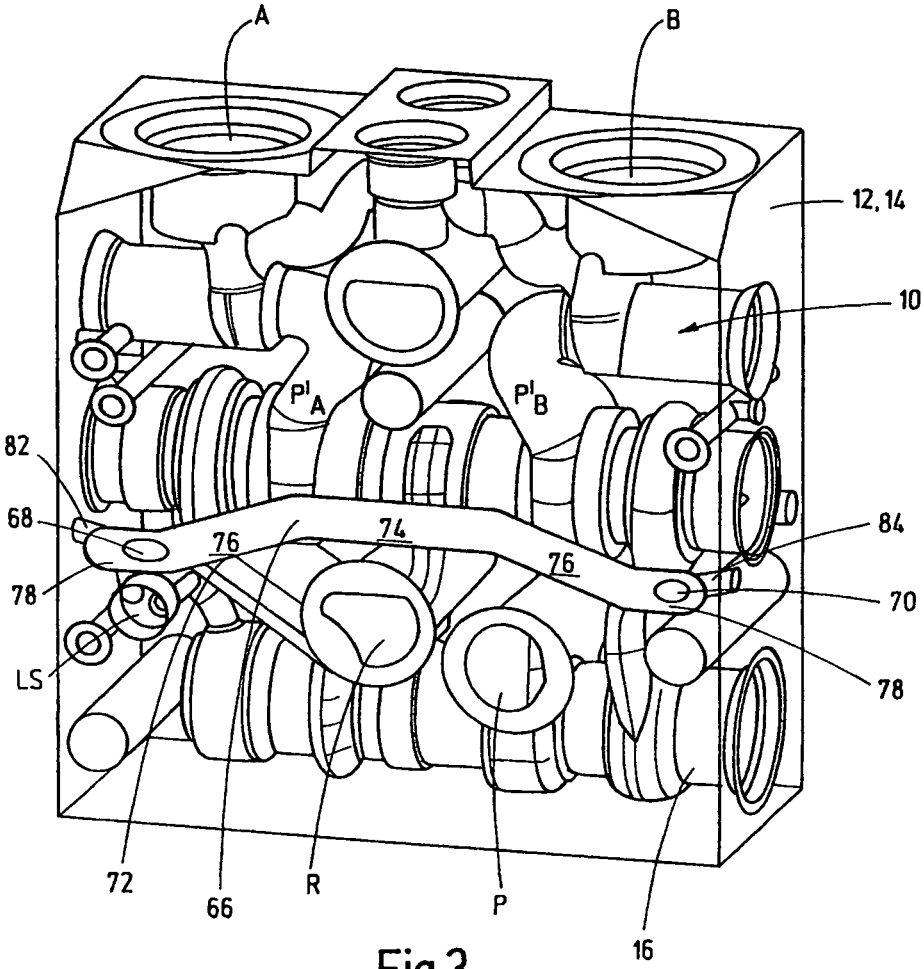
FIG. 3 is a perspective view of an extract relating to the valve block of FIGS. 1 and 2 with the fluid-guiding line parts, including fluid guidance in the form of the media channel as shown in FIG. 1.

For relaying the control pressure $X_B$ from the activation unit 46 to the assignable control side of the control device 18, which control side is located on the right, there is a media-carrying channel, in particular a fluid-carrying channel 66 whose guide path is apparent especially from FIGS. 1 and 3 and is omitted in FIG. 2 for the sake of simplicity. In particular, an open channel guide is implemented which can be closed by a cover part or other housing parts of the valve housing 14, which is made in several parts as a shut-off part. In the embodiment as shown in FIG. 3, shut-off of the open channel 66 with a cuboidal and flat cover part would be conceivable and as a component of the valve housing 14. Therefore as a shut-off part, the cover part can be connected to the remaining valve housing 14 by the cover part being connected to the remaining valve housing 14 by a screw connection which is not detailed. In this embodiment as shown in FIG. 1 which essentially relates to a longitudinal section through the valve housing which is otherwise shown as a half, the correspondingly made valve housing side which in this respect constitutes the other half would have to be connected fluid-tight to the illustrated valve housing. This housing part piece which is made complementary to the illustrated housing part piece comparably to FIG. 1 could then have the corresponding guide of the channel which then interacts accordingly with the illustrated channel 66 to carry media.

The guide path of the media channel 66, except for the two media passage sites 68, 70 to the assignable control side of the control device 18 and to the activation unit 46, is separated media-tight or fluid-tight, especially fluid-tight relative to the detachable shut-off part (cover part or valve housing part) by a sealing device 72 (not shown in FIG. 1) for the sake of simplicity. The sealing device 72 can be a peripheral lip seal (FIG. 3) of elastomer material or the like which can be inserted, for example, into a peripheral groove which encloses the respectively indicated media channel 66 with the two media passage sites 68, 70, forming a seal. As FIGS. 1 and 3 furthermore show, the guide path of the media channel 66 has a first path section 74 which, as viewed in the figures, is arranged essentially horizontally and parallel to the displacement directions of the spool valves 20, 22. This first center path section towards its respectively free end discharges into two other path sections 76 which have an oblique tilt extending downwardly relative to the first path section 74. The two free ends of the tilted path sections 76 then each discharge into two end sections 78 as third path sections which in turn extend in a horizontal arrangement parallel to the first path section 74. Then the media passage sites 68, 70 each discharge into the pertinent end sections 78. The symmetrically structured media channel 76 has proven especially favorable for laminar flow guidance so that potential power losses in fluid guidance, for example due to turbulence, do not arise.

The valve device according to the invention is used especially preferably for activation of hydraulic fluid. Other applications are also conceivable in which the medium is gaseous, for example, for implementing a pneumatic valve, or relates to other fluids, such as fuel, cooling lubricants, etc. As FIG. 1 furthermore shows, the control or pilot valve 50 on its output side discharges into a fluid-carrying pilot space 80 which discharges into the media passage site 68 via an oblique bore 82 which is only partially shown (FIGS. 1, 3). There is a corresponding oblique channel guide 84 (FIG. 3) for the connection of the media channel 76 by way of its passage site 70 to the rear spring space 40 of the control device 18.

With the indicated fluid guide arrangement, the two pilot valves 48, 50 each control the pertinent face side of the spool valve 20, 22. The control or pilot valve 48, which is the upper one in FIG. 1, controls the pressure $X_A$ in the left-hand pressure chamber on the left end of the spool valve 20. Conversely, the lower pilot valve 50 dictates the pressure $X_B$ in the activation line to the right face side of the spool valve 22. Due to the valve device arrangement according to the invention, it is not necessary to use an additional differential or actuating piston for activation to arrive at the desired valve design with a narrow structure. Instead of using a long, thin drill, which is susceptible to failure, to produce the pressure guide in one alternative embodiment, the described media-carrying channel 66 can be provided in a very favorable manner of production by a stable cutting tool so that valve scrap rates approach zero in production.

It is surprising to one with average skill in the art that one can arrive at valve designs which are kept narrow and which, in spite of the complexity of the valve, allow constructions with a width of less than 40 mm by the illustrated valve construction in which the activation housing 54 with all important components is flanged on the face side to the remaining control housing 12 without any projections with the essential valve components. If it is not critical to keep the size of the valve device very small or narrow, in the solution according to the invention a further mechanical degree of freedom arises by the power-routing channels being able to be made larger. This arrangement simplifies appropriately designing the required amounts of fluid for the working ports. In particular, larger fluid volumes can be managed. Due to the lower activation pressure in the groove-like connecting channel design, the wall distance to the pressure-carrying pressure spaces can be chosen to be small so that additional pressure loading of the respective flange surface remains small to benefit the operating reliability of the valve device as a whole.

While one embodiment has been chosen to illustrate the invention, it will be understood by those skilled in the art that various changes and modifications can be made therein without departing from the scope of the invention as defined in the appended claims.

What is claimed is:

1. A hydraulic valve, comprising:

a valve housing having a cover part;

a fluid port arrangement extending at least partially in said valve housing and including a pressure supply port for supplying working pressure, a return port, a section load sensing port, first and second control ports and first and second useful ports for providing useful port pressure;

a movable control device coupled to said ports for activating said ports, said control device being pressurizable with a control pressure from a respective activation unit on opposite first and second control sides of said control device; and a media-carrying channel connecting said activation unit with the respective control side of said control device for conveying control pressure therebetween, said media-carrying channel having a guide path extending at least partially as an open channel guide closed by said cover part as a shut off part, said guide path having a first path section opening at free ends thereof into second path sections tilted relative to said first path section, said first path section forming a middle section adjacent to said control device and having ends undergoing transitions into said second path sections to form intermediate sections, free ends of said intermediate sections undergoing transitions in end path sections being parallel to a direction of said first path section, free ends of said end path section opening respectively in directions of said activation and the respective control side of said control device.

2. A hydraulic valve device according to claim 1 wherein said guide path is separated fluid-tight relative to said cover part by a seal, except at media passage sites to the respective control side of said control device and said activation unit.

3. A hydraulic valve device according to claim 1 wherein said control device comprises at least one spool valve biased into a centered initial position by a spring.

4. A hydraulic valve device according to claim 1 wherein said activation unit comprises at least first and second control valves, said first control valve activating said first control side, said second control valve activating said second control side.

5. A hydraulic valve device according to claim 4 wherein said first and second control valves are combined in one unit on a face side of said valve housing.

6. A hydraulic valve device according to claim 5 wherein said valve housing comprises a port face side coupled to said activation unit and having a narrow cross section.

7. A hydraulic valve device according to claim 6 wherein said narrow cross section has a width not greater than 40 mm with said cover part.

8. A hydraulic valve device according to claim 4 wherein said first and second control valves are arranged with actuation directions parallel to an actuation direction of said control device.

* * * * *